US006257947B1

(12) United States Patent
Glaser

(10) Patent No.: US 6,257,947 B1
(45) Date of Patent: Jul. 10, 2001

(54) NOVELTY ARTICLE SELECTIVELY CHANGEABLE FROM A FIRST DEVICE TO A SECOND DEVICE

(76) Inventor: Robert F. Glaser, 22231 Mulholland Hwy., Suite 112, Calabasa, CA (US) 91302

( * ) Notice: Subject to any disclaimer, the term of this patent is extended or adjusted under 35 U.S.C. 154(b) by 0 days.

(21) Appl. No.: 09/176,366

(22) Filed: Oct. 21, 1998

(51) Int. Cl.[7] ..... A63H 3/00

(52) U.S. Cl. ..... 446/73; 446/71; 446/72; 446/321; 446/487

(58) Field of Search ..... 446/71, 72, 73, 446/321, 487; 206/373, 457; 81/177.4, 177.6, 490; 7/167, 168, 119; 16/110.1, 111.1, 430, 903; 248/908

(56) References Cited

U.S. PATENT DOCUMENTS

| | | | | |
|---|---|---|---|---|
| 390,633 | * | 10/1888 | Von Bultzingslowen . | |
| 1,309,281 | * | 7/1919 | Forbes . | |
| 1,510,420 | * | 9/1924 | Sherman . | |
| 4,204,294 | * | 5/1980 | Halverson | 15/185 |
| 4,269,311 | * | 5/1981 | Rich | 206/234 |
| 4,384,499 | * | 5/1983 | Shockley | 81/440 |
| 4,571,203 | * | 2/1986 | Murakami | 446/95 |
| 4,961,717 | * | 10/1990 | Hickey | 446/76 |
| 5,454,746 | * | 10/1995 | Guegan et al. | 446/72 |
| 5,588,898 | * | 12/1996 | Ooba | 446/321 |
| 5,779,046 | * | 7/1998 | Plakos | 206/362.3 |
| 5,787,535 | * | 8/1998 | Epstein | 7/118 |

FOREIGN PATENT DOCUMENTS

| | | |
|---|---|---|
| 809385 | 2/1959 | (GB) . |
| 959497 | 6/1964 | (GB) . |

* cited by examiner

*Primary Examiner*—Jacob K. Ackun, Jr.
*Assistant Examiner*—Bena B. Miller
(74) *Attorney, Agent, or Firm*—Baker, Donelson, Bearman & Caldwell

(57) ABSTRACT

An article selectively changeable from a first device (a toy) to a second device (a tool) in which a first shell and a second shell cooperatively define a cavity in which a tool is pivotally mounted, with the shells being movable from a first position spaced closely together to enclose the tool to a second position spaced-apart and open for moving an operative portion of the tool to an extended position outwardly of the shells, so that the article with the tool in the enclosed position is usable as a first device (for example, a toy) and with the tool in the extended position is usable as a second device (for example, a toothbrush). The tool is disclosed as a toothbrush, comb, flashlight, or writing instrument.

24 Claims, 5 Drawing Sheets

NOVELTY ARTICLE SELECTIVELY CHANGEABLE FROM A FIRST DEVICE TO A SECOND DEVICE

TECHNICAL FIELD

The present invention relates to articles which enclose tools. More particularly, the present invention relates to novelty tool-enclosing articles useful as first devices and selectively changeable to second devices for using the tools.

BACKGROUND OF THE INVENTION

In recent years, certain toys have been developed for enhancing creative play by youngsters using the toys. The toys generally combine elements of two or more unrelated objects, and are positionable selectively to form the objects. Typically, the changeable toy includes elements of a creature and elements of a physical object. The toy can be manipulated to form a play device which has the character of the creature or selectively as desired by the youngster to have the character of the physical object. The imaginary creature may be a monster, space alien, super hero or enemy character, or the like. The physical object may be a vehicle, including aircraft, water craft, cars and trucks, and as well as other devices. Often, the changeable toy has in at least one of its forms the appearance of an action figure which is associated with a licensed trademark brand for the figure or toy. The use of the licensed trademark brand facilitates the sale of the changeable device. Often the licensed trademark brand is associated with a broadcast or media-presented character. The device thereby is tied to the character, and the success and marketing popularity of one helps the success and marketing popularity of the other.

Licensing of trademark brands for goods generally is a multi-million dollar industry. Often the trademark brands are licensed for use with a wide range of goods or services. The goods include grooming aids for children such as combs, toothbrushes, mirrors, and the like. Accordingly, toys and grooming aid tools have generally been successful in facilitating the popularity of the licensed brand and sale of the licensed goods. These goods however are separate and different from the toys.

There remains a need in the art for an article which includes features of a first device useful of a first purpose with features of a second device useful for a separate, different purpose. It is to such that the present invention is directed.

SUMMARY OF THE INVENTION

The present invention meets the need in the art by providing an article that is selectively changeable from a first device useful for a first purpose to a second device useful for a second, different purpose. The article has a casing formed from a first shell and a second shell which cooperatively define a cavity within the casing. The first shell and the second shell are movable from a first position spaced closely together whereby the cavity is substantially closed to a second position with the first shell and the second shell spaced apart whereby the cavity is open. Connector means extend between respective inner surfaces of the first shell and the second shell for connecting the shells together while permitting the shells to move apart. A tool pivotally mounts within the cavity. The tool is disposable in a first position enclosed within the cavity with the first shell and the second shell being in the first position, and with the first shell and the second shell moved to their second positions, the tool is moveable from the first position to a second position with an operative portion of the tool disposed outwardly of the casing. The article with the tool in the first position is usable as a first device and with the tool in the second position is usable as a second device. The tool is disclosed as a toothbrush, a writing instrument, a comb, a mirror, and a flashlight.

Objects, advantages and features of the present invention will become apparent from reading the following detailed description of the invention and claims in view of the appended drawings.

DETAILED DESCRIPTION OF THE PREFERRED EMBODIMENTS

Figure 1:
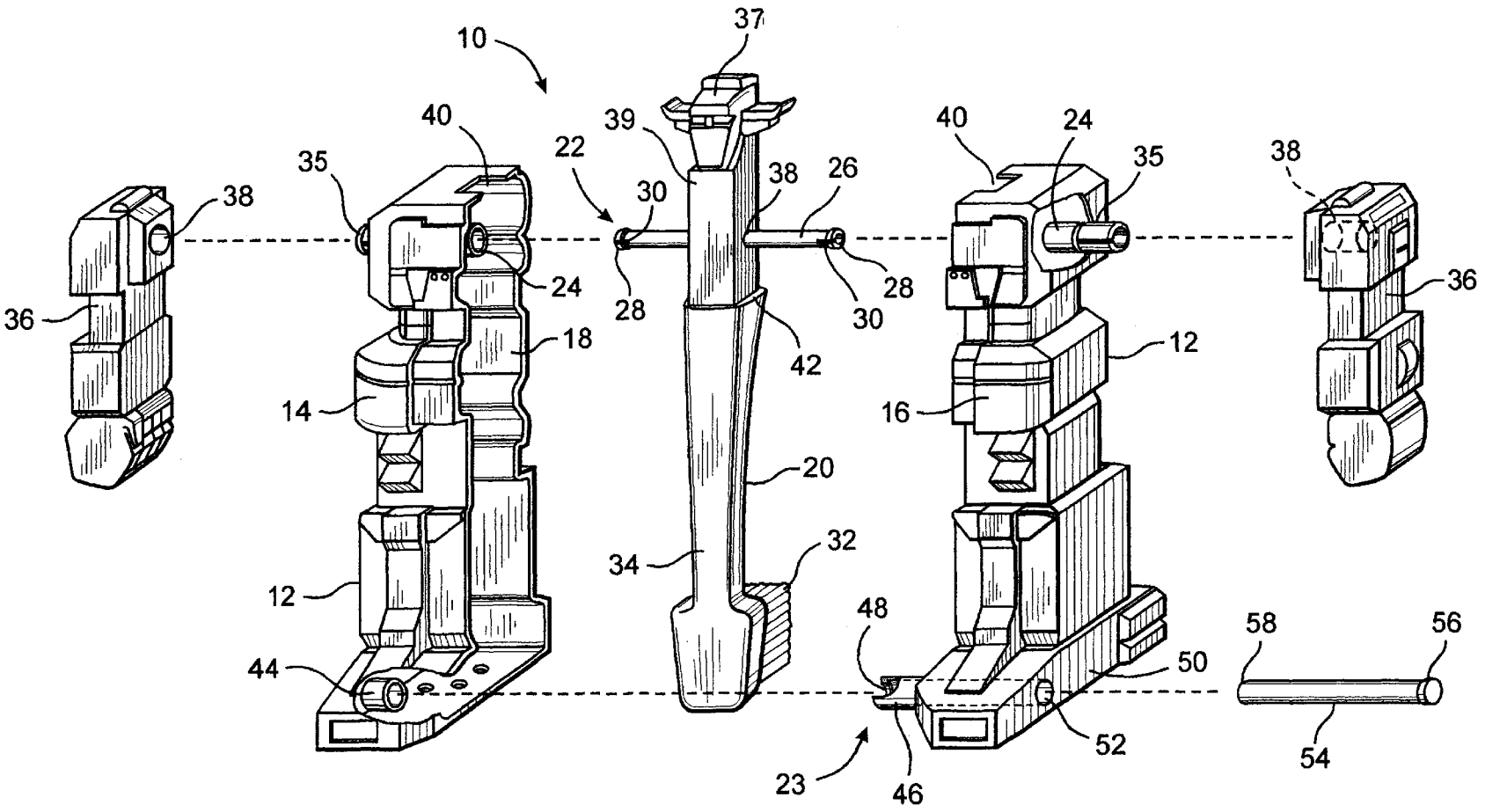
FIG. 1 is a perspective, exploded view of a novelty article according to the present invention, which is selectively changeable from a first device to a second device.

Referring now in more detail to the drawings, in which like numerals indicate like parts throughout the several views, FIG. 1 illustrates in perspective exploded view a novelty article 10 according to the present invention, which is selectively changeable from a first device (a toy) useful for a first purpose to a second device (a toothbrush, in the illustrated embodiment) useful for a separate, different purpose. The article 10 includes a casing 12, which in the illustrated embodiment has the ornamental appearance of a robot. It is to be appreciated that the casing 12 may take the ornamental appearance of one of a number of different characters, including ships, air craft, and imaginary creatures, to name but a few.

A first shell 14 and a second shell 16 define the casing 12. The shells 14, 16 cooperatively define a cavity generally 18 for enclosing a tool 20 within the casing. The first shell 14 and the second shell 16 are movable between a first position with the shells 14, 16 spaced closely together whereby the cavity 18 is substantially closed and a second position with the first shell and the second shell spaced apart whereby the cavity is open.

A pair of connectors 22, 23 guide the movement of the shells 14, 1,6. The connectors 22, 23 are preferably spaced-apart and attached to the shells 14, 16 in respective portions of their longitudinal ends. The connector 22 includes a pair of opposing sockets 24 that extend laterally from respective inner surfaces of the first shell 14 and the second shell 16.

A pivot member 26 has a pair of opposing distal ends 28 coaxially received by the sockets 24. In the illustrated embodiment, the pivot member 26 is an elongate cylindrical rod. The distal ends 28 each define slots 30 extending longitudinally from the ends. The slots 30 enables the distal ends 28 to flex as the member 26 is received in the opposing sockets 24.

The tool 20 is engaged to the pivot member 26. Preferably the tool 20 is centrally disposed on the pivot member 26. The tool 20 in the illustrated embodiment defines a toothbrush having a plurality of bristles 32 extending from an operative portion of an elongate member 34. In an alternate embodiment, the tool comprises a reflective mirror connected to the member 26. An opposing distal end 37 of the member 34 is ornamentally configured for cooperation with the casing 12 for use of the article 10 as a first device. In the illustrated embodiment, the distal end 37 is configured as a head of a robot.

The member 34 defines a bore 38 through which the pivot member 26 extends. The member 34 defines a narrowed portion 39 and a shoulder 42. The bore 38 preferably extends through the narrowed portion.

The sockets 24 open on the exterior of the shells 14, 16 to lugs 35. In the illustrated embodiment, the lugs 35 project from a shoulder portion of the robot. Members 36 configured as arms and hands for the robot define recesses 38 which receive the lugs 35. A pair of opposing notches 40 are defined in the shells 14, 16. The notches 40 are sized for receiving the narrowed portion 39 of the member 38, as discussed below.

The second connector 23 is spaced-apart from the first connector 22. The second connector comprises a second socket 44 extending from the first shell 14 and an opposing third socket 46 extending from the second shell 16. A distal end of the socket 46 defines an extended annular lip 48 on an inner surface. A lateral side 50 of the second shell 16 defines an opening 52 coaxial with the third socket 46. A pin 54 has a flange 56 at a first end. An opposing end 58 of the pin 54 is received through the opening 52 in the second shell 16. The opposing end 58 engages the second socket 44 in the first shell 14. The pin 54 is sized for sliding longitudinally relative to the socket 46. The lip 48 and the flange 56 contact together to define a stop for the second connector 23.

Figure 2:
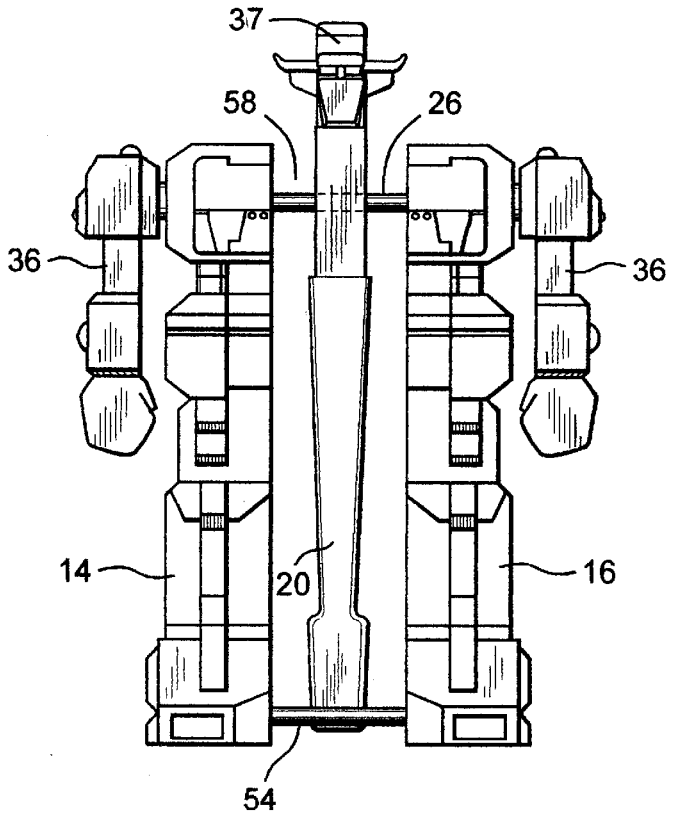
FIG. 2 is a front view of the novelty article illustrated in FIG. 1, with the casing opened to permit rotation of the tool from an enclosed first position to an extended second position.

FIG. 2 is a front view of the novelty article 10 illustrated in FIG. 1, with the casing 12 opened by the first shell 14 and the second shell 16 being moved to second positions. The shells thereby define a gap 58 therebetween. With the casing 12 opened, the tool 20 is movable from an enclosed first position to an extended second position, as discussed below.

Figure 3:
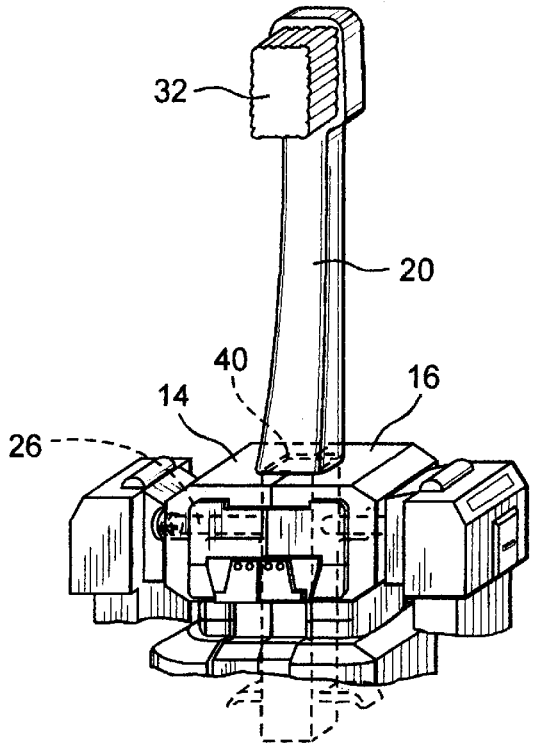
FIG. 3 is a perspective, partial view with the novelty article with the tool in the extended second position illustrating the casing closed with the tool extending through a notch in the surface of the casing.

FIG. 3 is a perspective, partial view with the novelty article 10 with the tool 20 in the extended second position. The casing 12 is closed with the tool 20 extending through the notches 40 in casing.

Figure 4:
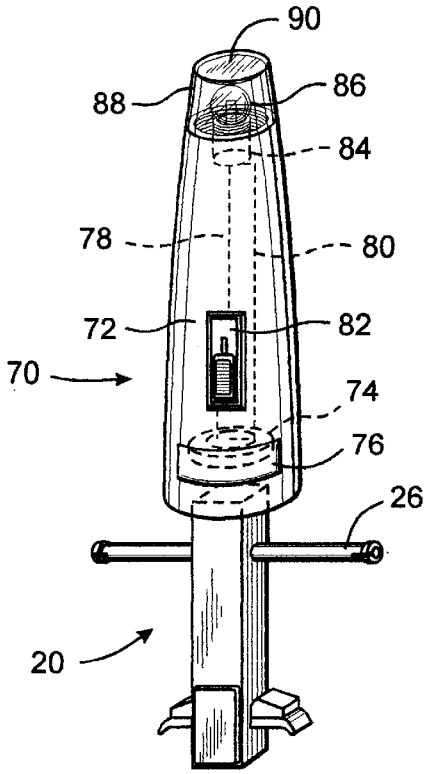
FIG. 4 is a perspective, cut-away view of an alternate embodiment of the tool as a flashlight.

FIG. 4 is a perspective, cut-away view of an alternate embodiment of the tool 20 as a flashlight 70. The body 72 of the flashlight 70 defines a battery cavity 74 which is closed by a removable cover 76. A pair of wires 78, 80 communicate through a switch 82 to a socket 84 which receives a lamp 86. The lamp 86 is enclosed within a removable threaded cap 88 having a lens 90.

Figure 5:
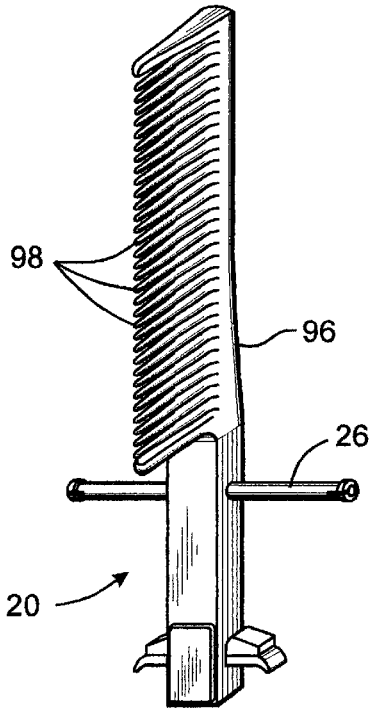
FIG. 5 is a perspective, view of an alternate embodiment of the tool as a comb.

FIG. 5 is a perspective, view of an alternate embodiment of the tool 20 as a comb 96 having a plurality of teeth,98.

Figure 6:
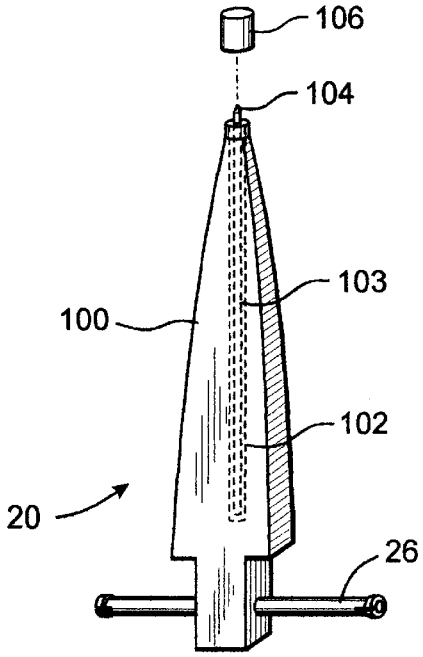
FIG. 6 is a perspective, view of an alternate embodiment of the tool as a writing instrument.

FIG. 6 is a perspective, view of an alternate embodiment of the tool 20 as a writing instrument 100. The tool 20 defines a longitudinal bore 102 which is closed by a nib 104. The bore 102 receives an ink supply, such as from a conventional ink supply tube 103, which is communicated to the nib 104 for application to a paper or other receiving media. A cap 106 covers the nib 104 when not in use and enclosed in the casing 12. Other conventional writing instruments are readily incorporated into the tool 20.

Figure 7:
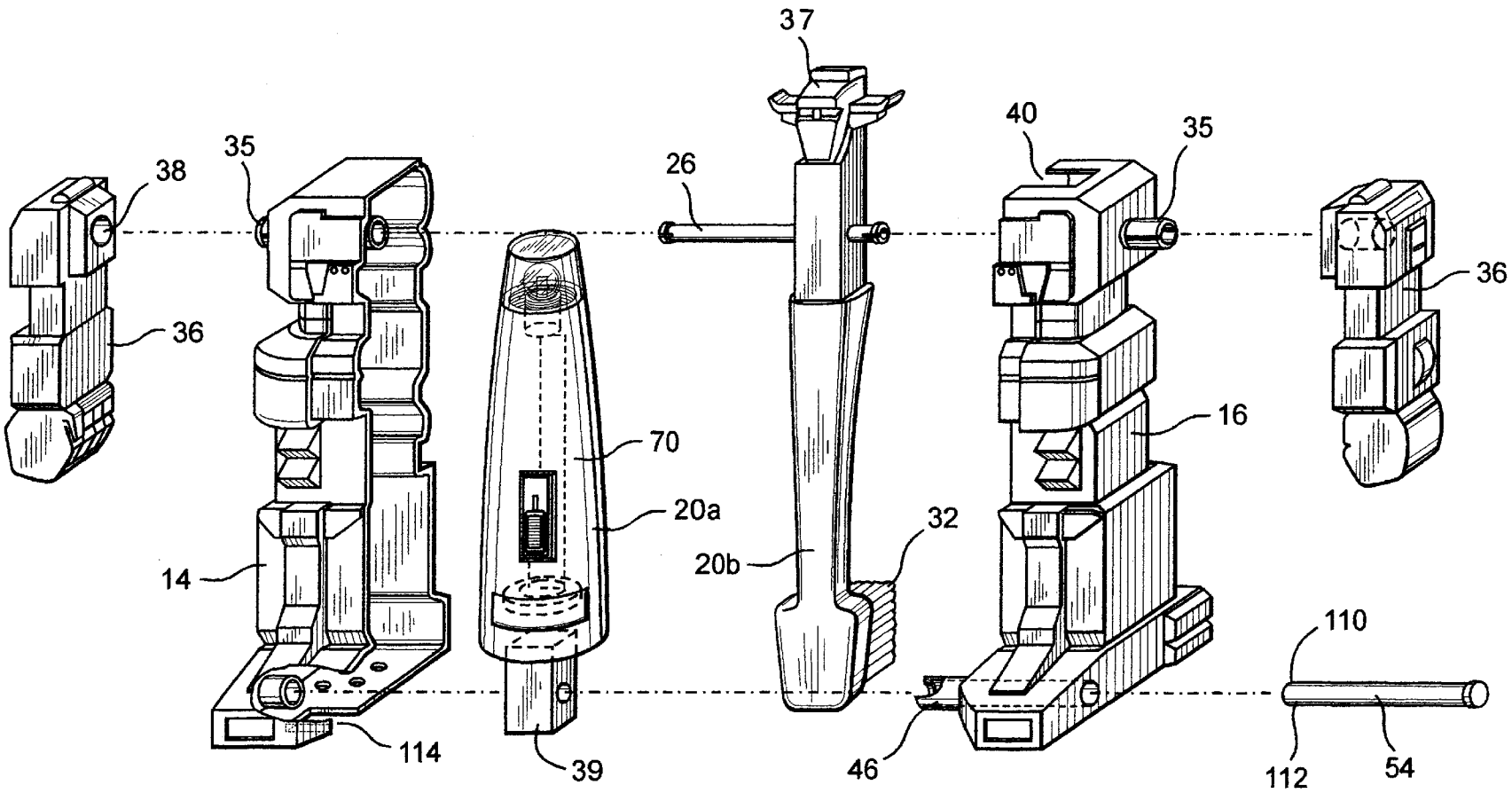
FIG. 7 is a perspective, exploded view of a novelty article in an alternate embodiment enclosing two tools.

FIG. 7 is a perspective exploded view of an, alternate embodiment of the article 10, in which two tools 20*a* and 20*b* are enclosed for selective changing of the article into another device. In this embodiment, the pin 54 terminates in a distal end 110 having a slot 112. The socket 44 in the first shell 14 receives the distal end 110, for axial rotation. The tool 20*a* connects to the pivot member 26 and is laterally spaced from a longitudinal axis of the casing 12 towards the second shell 16. The tool 20*b* connects to the pin 54 on an opposing side of the longitudinal axis towards the first shell 14. The tools 20*a* and 20*b* are substantially parallel and spaced apart for independent selective pivoting without interference from the other one of the tools.

The first shell 14 has a notch 114 in a surface longitudinally opposing the notch 40 in the second shell 16, for receiving the narrowed portion of the tool 20*b*. In this illustrated embodiment, the distal end portion of the tool 20*b* is reduced in size, and does not extend outwardly of the casing 10 when the tool 20*b* is in the enclosed first position. However, it is to be appreciated that the distal end of the tool 20*b* may be appropriately configured to cooperate with the ornamental appearance and character of the casing 10.

The article 10 is readily and conventionally formed with plastic molding processes and equipment. The shells 14, 16 carry an ornamental appearance of the first device. With reference to FIGS. 1 and 2, the shells 14, 16 join together with the telescoping connectors 22, 23. This is accomplished by first connecting the pivot member 26 to the tool 20. The pivot member 26, preferably a cylindrical rod, passes through the bore 38. The diameter of the central portion of the pivot member 26 is slightly enlarged for force-fitting in the bore 38. One of the distal ends 28 of the pivot member 26 is engaged to the socket 24 of the shell 14. The slots 30 permit the ends 28 to flex to a reduced diameter for being received into the sockets 24. The shells 14, 16 are aligned, and the other of the ends 28 is aligned with the socket 24 in the second shell 16. The pin 54 inserts through the opening 52 in the second shell 16. The pin 54 slidably passes through the socket 46. The socket 44 in the first shell 14 engages the distal end 58. The distal end 58 is preferably engaged with adhesive in the socket 44. The other distal end 28 of the pivot member 26 engages the socket 24 of the shell 16. As the shells 14, 16 are moved laterally apart and together, the pin 54 telescopically travels relative to the socket 46 and the distal end portions 28 of the pivot member 26 telescopically travel in the respective sockets 24.

The members 36 snap onto the lugs 35. The lugs 35 permit the members 36 to rotate, but these elements may be adhered together with an adhesive. It is to be appreciated that the members 36 have a character and ornamental appearance consistent with the character and ornamental appearance of the casing 12. For example, in an embodiment in which the casing 12 has the character of an aircraft, the members 36 have the character of wings.

In reference to FIGS. 1–3, the article 10 is operated to be used selectively as a first device having a first purpose while also enclosing the tool 20 and used as a second different device in which the tool 20 is extended for a separate, different second purpose. The article 10 is assembled as described above. The shells 14, 16 close together and enclose the tool 20. The article 10 is then used as the first device (i.e., a toy such as the illustrated robot).

The article 10 is readily changeable to the second device (a tool). This is accomplished by moving the first shell 14 and the second shell 16 laterally apart to form the gap 58 between facing edges of the shells, as illustrated in FIG. 2. The connectors 22, 23 telescopically guide the shells 14, 16 in their relative movement between the first and second positions. Specifically, the pivot member 26 slides longitudinally in the sockets 24 as the shells move apart. The pin 54 slides relative to the socket 46. The flange 56 of the pin 54 engages the lip 48 of the socket 46 to stop the laterally apart movement of the first shell 14 and the second shell 16.

The tool 20 (a toothbrush in the illustrated embodiment) is disposed in the enclosed first position as shown in FIG. 2. The tool 20 is movable to the extended second position by rotating the tool axially about the pivot member 26 which rotates axially in the sockets 24. This positions the tool 20 with the operative portion exterior of the casing 12. The shoulder 42 aligns with an exterior surface of the casing and the notch 40. The first shell 14 and the second shell 16 are then moved together to close the casing 12, as illustrated in FIG. 3. The connectors 22, 24 guide the reverse movement of the shells 14, 16. The notches 40 close around the narrowed portion 39 of the tool member 34 at the shoulder 42. The article 10 thereafter is usable for a toothbrush.

After use as such, the article 10 is readily changed back to the robot toy. This is accomplished by moving the shells 14, 16 laterally apart to form the gap 58 between shells. The connectors 22, 24 guide the lateral movement of the shells 14, 16, as discussed above. The tool 20 is then pivoted about the pivot member 26 which turns in the sockets 24 to move the tool 20 to the first position. The shells 14, 16 are then moved in opposing directions towards each other, and as guided by the connectors 22, 23, return to the first position with the casing 12 enclosing the tool 20. The article 10 is then usable as the first device for the first purpose, which for the illustrated embodiment, is a toy robot.

With reference to FIG. 4, the article 10 is selectively usable as a toy and as a flashlight. The cover 76 is detached from the body 72 of the flashlight 70 for insertion of a battery into the battery cavity 74. The battery cavity 74 is then closed by replacing the cover 76. The operative portion of the flashlight 70 is disposed exterior of the casing 12 as discussed above by moving the shells 14, 16 apart laterally and rotating the flashlight 70 from the enclosed first position to the extended second position. The switch 82 is operated to allow electrical current to pass through the wires 78, 80 to the socket 84 for causing the lamp 86 to emit light through the lens 90. A cap 88 conventionally threads on a distal end of the body 72 for access to the lamp 86.

With reference to FIG. 5, the article 10 is selectively usable as a toy and as a comb, The operative portion (comb teeth 98) of the tool 20 is disposed exterior of the casing 12 as discussed above by moving the shells 14, 16 apart laterally and rotating the tool 20 from the enclosed first position to the extended second position. The shells 14, 16 are then moved to their first positions to close the casing 12. The comb 96 is then usable for grooming hair. The article 10 is readily changed to the first device by opening the casing 12, rotating the tool 20 to the enclosed first position, and closing the casing.

With reference to FIG. 6, the article 10 is selectively usable as a toy and as a writing instrument. The operative portion (the nib 104) of the tool 20 is disposed exterior of the casing 12 as discussed above by moving the shells 14, 16 apart laterally and rotating the tool 20 from the enclosed first position to the extended second position. The shells 14, 16 are then moved to their first positions to close the casing 12. The cap 106 is removed and the tool used for writing. The article 10 is readily changed to the first device by opening the casing 12, rotating the tool 20 to the enclosed first position, and closing the casing.

It is to be appreciated that the casing 12 can include more than one tool, as illustrated in FIG. 7. The tools 20*a* and 20*b* are laterally offset from a central longitudinal axis in order that the tools 20*a* and 20*b*, when individually moved to their respective extended positions, do not interfere with each other. It is noted that in this embodiment, the pin 54 rotates in the socket 44 to permit rotation of the tool 20*a* between its respective enclosed and extended positions. The notch 114 in the first shell 14 receives the narrowed portion 39 of the tool 20*a*. Further, both tools 20*a* and 20*b* can be disposed in extended positions simultaneously, if desired.

It is a teaching of the present invention that the tool 20 while preferably embodying a utility tool as disclosed herein, can rather embody structures with characterizations and appearances consistent with the article being used for a second device such as a second type of toy.

Figure 8:
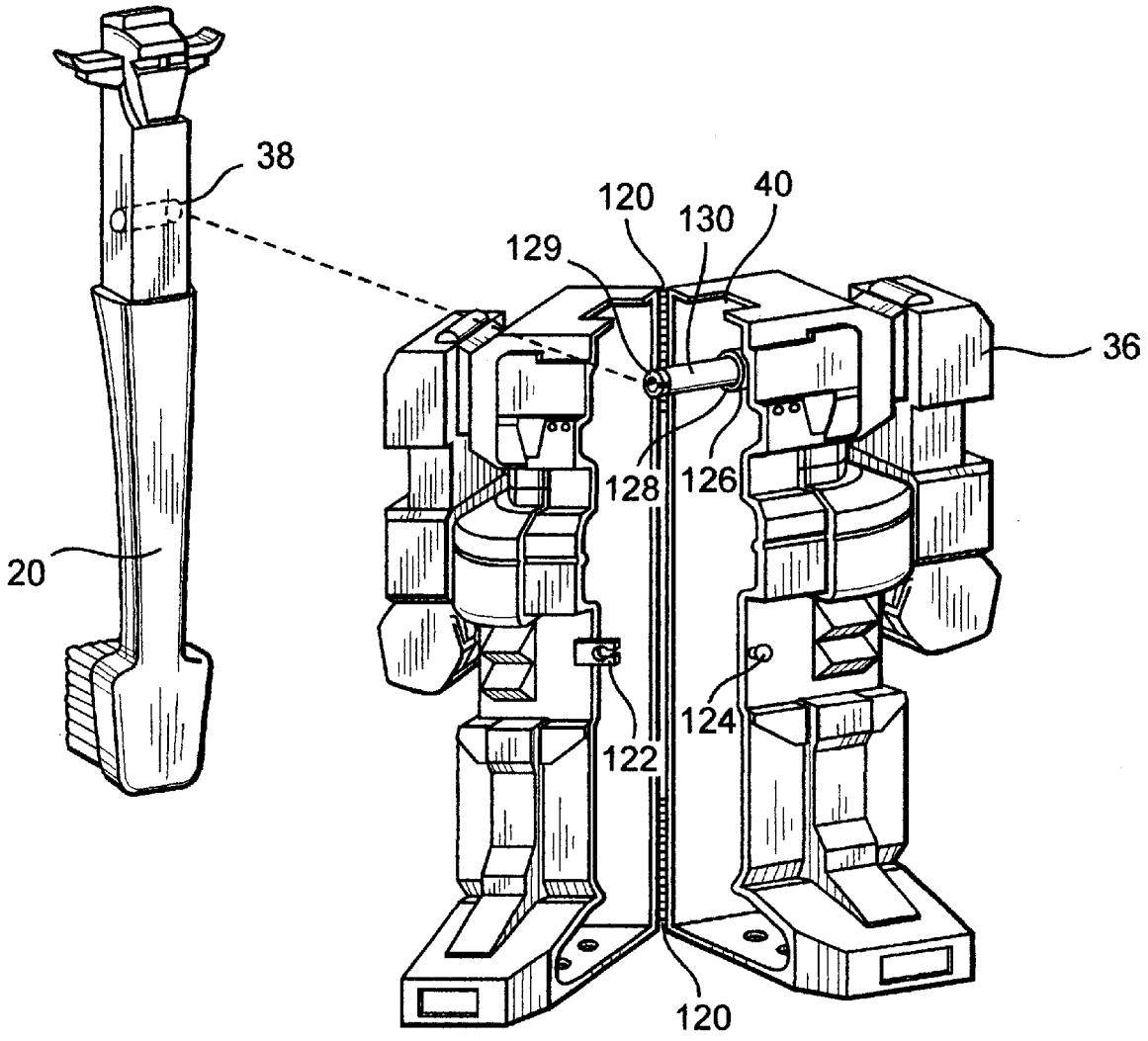
FIG. 8 is an perspective view of an alternate embodiment of the novelty article.

In an alternate embodiment illustrated in FIG. 8, the first shell 14 connects by a pair of hinges 120 to the second shell 16, such as integral "living" hinges joining the shells 14, 16. The hinges 120 guide the movement of the first shell 14 and the second shell 16 between the closed position and the illustrated open position. When the shells 14, 16 are moved to the closed position, a closure tab 122 engages a stub 124 for holding the first shell 14 and the second shell 16 closed together. The tool 20 pivotally connects to a post 126 extending from the inner surface of the second shell 16. The post 126 defines a pair of spaced-apart annular ridges 128, 129 which define a channel 130 for receiving the tool 20 by slidingly inserting the post 126 through the bore 38 until the ridge 129 extends outwardly of the bore. The tool 20 rotates about the channel 130 of the post 126 to move from the enclosed position to the extended position. The tool 20 rotates selectively between the enclosed position in the cavity 18 of the shells 14 and 16 and extended outwardly through the notch 40. The shells 14, 16 open selectively by disengaging the stub 124 from the tab 122 and pivoting on the hinges 120, and close by reverse movement pivoting on the hinges 120. In another alternate embodiment (not illustrated) the first shell 14 also includes a post for pivotally engaging a second tool 20. This embodiment includes a notch in the, first shell 14 through which the second tool extends.

The present invention accordingly provides an article which is selectively changeable from a first device for a first purpose while enclosing a tool in an interior cavity to a second device useful for a separate, different second purpose with the tool extended outwardly of the article. The movement of the first shell 14 and the second shell 16 between their first and second positions is guided by connectors which in a preferred embodiment are the pivot member 26 slidably moving in the sockets 24 and by the pin 54 slidably moving in the socket 46, although an alternate embodiment gainfully employs a hinged connector.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. An article selectively changeable from a first device to a second device, comprising:

a casing having a first shell and a second shell which cooperatively define a cavity within the casing, the first shell and the second shell being movable laterally from a first position spaced closely together whereby the cavity is substantially closed to a second position with the first shell and the second shell spaced apart whereby the cavity is open;

connector means extending across the cavity between respective inner surfaces of the first shell and the second shell for connecting the shells together while permitting the shells to move apart; and a tool pivotally mounted to the connector means within the cavity and disposable in a first position enclosed within the cavity with the first shell and the second shell being in the first position, and with the first shell and the second shell moved to their second positions, said tool being moveable from said first position to a second position with an operative portion of the tool disposed outwardly of the casing, whereby the article with the tool in the first position is usable as a first device and with the tool in the second position is usable as a second device.

2. The article as recited in claim 1, wherein said connector means comprises:

a pair of opposing sockets in the first shell and the second shell; and a pivot member having distal ends co-axially received by the opposing sockets and being longitudinally slidable and axially rotatable in the opposing sockets.

3. The article as recited in claim 1, wherein said connector means comprises:

a socket extending from the first shell; and a pin extending from the second shell and slidably received in the socket.

4. The article as recited in claim 3, further comprising means for stopping the laterally outward movement of said first and second shells.

5. The article as recited in claim 4, wherein the stop means comprises:

the socket defining a lip on an inner surface at a distal end; and the pin defining a flange on a distal end, whereby the pin moving longitudinally in the socket, bears the flange against the lip to stop the lateral outward movement of the first and second shells.

6. The article as recited in claim 1, wherein said connector means comprises:

a first socket extending from the first shell;

a second socket extending from the second shell opposing said first socket and defining a lip on an inner surface at a distal end;

a lateral side of the second shell defining an opening coaxial with the second socket; and a pin having a flange at a first end and a second opposing end received in the first socket, said pin being received therein by slidably extending through the opening, the first shell and the second shell guided in their movement between the first and second positions by the pin sliding relative to the first socket, and the flange of the pin engaging the lip to stop the laterally outward movement of said first and second shells.

7. The article as recited in claim 1, wherein at least one of the first shell and the second shell includes a notch in an edge for engagingly receiving a portion of the tool when it is disposed in the second position.

8. The article as recited in claim 1, wherein the tool comprises a tooth brush with a plurality of bristles comprising the operative portion of the tool.

9. The article as recited in claim 1, wherein the casing has an ornamental exterior surface consistent with a nature and character of a toy.

10. The article as recited in claim 9, wherein the casing defines a humanoid shape with feet, legs, torso, and shoulders; and further comprising:

arms attached to the shoulders; and a head formed on a first end of the tool opposite the operative portion thereof, whereby the article with tool in the first position has a head disposed exterior of the casing.

11. The article as recited in claim 9, wherein the operative portion of the tool comprises a plurality of bristles extending laterally therefrom for use as a tooth brush.

12. The article as recited in claim 9, wherein the first shell and the second shell define opposing notches in sides thereof, whereby the tool, being disposed in the second position, is held within the notches when the first and the second shells are moved to their first position.

13. The article as recited in claim 9, further comprising means for stopping the lateral outward movement of the first shell and the second shell.

14. The article as recited in claim 13, wherein said connector means comprises:

a socket extending from the first shell; and a pin extending from the second shell and slidably received in the socket; and the stop means comprises:

the socket defining a lip on an inner surface at a distal end; and the pin defining a flange on a distal end, whereby the pin moving longitudinally in the socket, bears the flange against the lip to stop the lateral outward movement of the first and second shells.

15. A tool-holding apparatus, comprising:

a casing having a cavity defined by two opposing shells which are movable laterally from a first position which substantially closes the cavity to a second position which opens the cavity;

a tool pivotally mounted within the cavity and movable from a first position in the cavity to a second position with an operational portion of the tool disposed exterior of the casing;

means for guiding the movement of the shells between the first position and the second position, whereby the tool-holding apparatus with the tool in the first position is useable as a first device and with the tool in the second position is usable as a second device.

16. The tool-holding apparatus as recited in claim 15, wherein means for guiding comprises a member extending from an interior surface of one of the shells and telescopically received for sliding movement in a second member extending from an interior surface of the other of the shells.

17. The tool-holding apparatus as recited in claim 15, wherein means for guiding comprises:

a telescoping connector having a rod member extending from an interior surface of one of the shells and a first receiving member extending in coaxial alignment therewith from an interior surface of the other of the shells and receiving a portion of the rod member; and a pair of opposed second receiving members extending from the interior surfaces of the shells spaced-apart from the telescoping connector; and an axle having a pair of distal ends which are slidably received in the pair of second receiving members, the tool mounted to the axle for pivotal movement between the first position and the second position.

18. The tool-holding apparatus as recited in claim 17, wherein:

a distal free end of the rod member terminates in an annular flange; and the first receiving member includes an interior annular flange at a distal free end, whereby the annular flange on the rod member bears against the interior annular flange of the receiving member as a stop when the shells are moved laterally to the second position.

19. The tool-holding apparatus as recited in claim 18, wherein the rod member is fixed at a first end in a third receiving member that extends from the interior surface of said one of the shells.

20. An article selectively changeable from a first device to a second device, comprising:

a casing having a first shell and a second shell which cooperatively define a cavity within the casing, the first shell and the second shell being movable laterally from a first position spaced closely together whereby the cavity is substantially closed to a second position with the first shell and the second shell spaced apart whereby the cavity is open;

a pair of opposing first sockets extending laterally from respective inner surfaces of the first shell and the second shell;

an axle having distal ends co-axially received by the first sockets, said axle being slidable longitudinally in said first sockets and axially rotatable therein;

a second socket extending from the second shell;

a third socket extending from the first shell opposing said second socket and defining a lip on an inner surface at a distal end;

a lateral side of the first shell defining an opening coaxial with the third socket; and a pin having a flange at a first end and a second end thereof received in said second socket by slidably extending through the opening, a tool mounted to the axle and disposable in a first position enclosed within the cavity with the first shell and the second shell being in the first position, and with the first shell and the second shell moved laterally to their second positions guided by said axle slidably moving in the sockets and by said pin slidably moving in said third socket with the flange of the pin engaging the lip to stop the laterally outward movement of said first and second shells, said tool being pivotally moveable from said first position to a second position with an operative portion of the tool disposed outwardly of the casing, whereby the article with the tool in the first position is usable as a first device and with the tool in the second position is usable as a second device.

21. An article selectively changeable from a first device to a second device, comprising:

a casing having a first shell and a second shell which cooperatively define a cavity within the casing, the first shell and the second shell being movable laterally from a first position spaced closely together whereby the cavity is substantially closed to a second position with the first shell and the second shell spaced apart whereby the cavity is open;

a first socket extending from the first shell;

a second socket extending from the second shell opposing said first socket and defining a lip on an inner surface at a distal end;

a lateral side of the second shell defining an opening coaxial with the second socket;

a pin having a flange at a first end and a second opposing end received in the first socket, said pin being received therein by slidably extending through the opening, the first shell and the second shell guided in their movement between the first and second positions by the pin sliding relative to the first socket, and the flange of the pin engaging the lip to stop the laterally outward movement of said first and second shells; and a tool pivotally mounted within the cavity and disposable in a first position enclosed within the cavity with the first shell and the second shell being in the first position, and with the first shell and the second shell moved to their second positions, said tool being moveable from said first position to a second position with an operative portion of the tool disposed outwardly of the casing,

0whereby the article with the tool in the first position is usable as a first device and with the tool in the second position is usable as a second device.

22. The article as recited in claim 21, wherein the tool comprises a tooth brush with a plurality of bristles comprising the operative portion of the tool.

23. An article selectively changeable from a first device to a second device, comprising:

a casing having a first shell and a second shell which cooperatively define a cavity within the casing, the first shell and the second shell being movable laterally from a first position spaced closely together whereby the cavity is substantially closed to a second position with the first shell and the second shell spaced apart whereby the cavity is open;

connector means extending between respective inner surfaces of the first shell and the second shell for connecting the shells together while permitting the shells to move apart; and a tool pivotally mounted within the cavity and disposable in a first position enclosed within the cavity with the first shell and the second shell being in the first position, and with the first shell and the second shell moved to their second positions, said tool being moveable from said first position to a second position with an operative portion of the tool disposed outwardly of the casing;

the casing defining a humanoid shape with feet, legs, torso, and shoulders; and further comprising:

arms attached to the shoulders; and a head formed on a first end of the tool opposite the operative portion thereof, whereby the article with the tool in the first position has a head disposed exterior of the casing, whereby the article with the tool in the first position is usable as a first device and with the tool in the second position is usable as a second device.

24. The article as recited in claim 23, wherein the tool comprises a tooth brush with a plurality of bristles comprising the operative portion of the tool.

* * * * *